United States Patent [19]

Snider

[11] Patent Number: 5,000,264

[45] Date of Patent: Mar. 19, 1991

[54] METHOD AND MEANS FOR INTRODUCING TREATMENT FLUID INTO A SUBTERRANEAN FORMATION

[75] Inventor: Philip M. Snider, Houston, Tex.

[73] Assignee: Marathon Oil Company, Findlay, Ohio

[21] Appl. No.: 485,116

[22] Filed: Feb. 26, 1990

[51] Int. Cl.[5] ..... E21B 43/00

[52] U.S. Cl. ..... 166/372; 166/105; 166/106; 166/242; 166/308; 166/323; 166/386

[58] Field of Search ..... 166/305.1, 308, 312, 166/370, 372, 373, 386, 105, 106, 317, 242, 323, 332

[56] References Cited

U.S. PATENT DOCUMENTS

| | | | |
|---|---|---|---|
| 3,627,045 | 12/1971 | Lebourg | 166/278 |
| 3,687,202 | 8/1972 | Young et al. | 166/305 |
| 4,260,020 | 4/1981 | Nelson et al. | 166/308 |
| 4,605,069 | 8/1986 | McClaflin et al. | 166/372 |
| 4,662,831 | 5/1987 | Bennett | 417/430 |
| 4,726,420 | 2/1988 | Weeks | 166/372 |
| 4,846,280 | 7/1989 | Snider | 166/386 |

*Primary Examiner*—Bruce M. Kisliuk

*Attorney, Agent, or Firm*—Jack L. Hummel; Jack E. Ebel

[57] ABSTRACT

Method and apparatus for introducing treatment fluid into a subterranean formation by use of a reverse jet pump located in a bypass of a tubing string. A plug in the tubing between the inlet and outlet of the bypass forces production fluid to flow through the bypass. When operation of the jet pump is terminated treatment fluid introduced into the tubing string causes a sleeve to slide down over the inlet and outlet, isolating the bypass. The plug is then forced out the tubing, leaving a clear path for the treatment fluid down the tubing and out the casing perforations into the formation. This arrangement enables rapid changeover from pumping formation fluid to introducing treatment fluid.

25 Claims, 4 Drawing Sheets

METHOD AND MEANS FOR INTRODUCING TREATMENT FLUID INTO A SUBTERRANEAN FORMATION

FIELD OF THE INVENTION

This invention relates to the introduction of treatment fluid into a subterranean formation. More particularly, it relates to a method and apparatus which enables treatment fluid to be introduced within a very short period of time after terminating production of the formation.

BACKGROUND OF THE INVENTION

In the production of hydrocarbons from low permeability formations, fracture stimulation is often employed to enhance productivity and improve deliverability of the production fluid. This is typically accomplished through hydraulic fracturing, which involves the introduction of a gel or other high viscosity fluid into the formation of interest under sufficiently high pressure to create fissures in the formation. At the conclusion of the fracturing process the viscosity of the hydraulic fluid is reduced, commonly by the introduction of a gel breaker or by the action of a gel breaker originally included in the fluid. When the high pressure is released the formation fluid flows through the newly created fissures at an increased rate. In order to maintain the fissures in an open condition after removal of the hydraulic fracturing fluid, propping agents such as sand are included in the hydraulic fluid and are carried with it into the newly formed fissures. When the hydraulic fluid is removed the sand remains, holding the fissures open.

Although such hydraulic fracturing procedures are well known in the industry, it is nevertheless often difficult to concentrate the process in the particular producing zone of interest due to the tendency of the fracturing fluid to enter surrounding nonproducing layers. To afford better control of the flow of the fracturing fluid the zone to be fractured ideally should be at a lower pressure than the surrounding confining layers, which would cause the hydraulic fluid to preferentially seek and remain in the zone of interest. Prior to the present invention, no practical way to achieve this condition has been known.

BRIEF SUMMARY OF THE INVENTION

The invention is carried out by producing fluid from a formation of interest to lower the pressure of the formation near the wellbore. The fluid flows through perforations in a casing and is lifted up through tubing located within the casing. The formation fluid is prevented from flowing into the annulus between the tubing and the casing by suitable sealing means, such as a standard form of packer used for this purpose. The formation fluid is blocked from flowing directly up the tubing by a plug or other blocking means and is caused to enter a passageway which bypasses the tubing blocking means and exits into the tubing at a point above the blocking means. When production of the formation fluid has drawn down the pressure of the formation sufficiently, the fluid lifting operation is halted and the tubing blocking means is removed to permit hydraulic fracturing fluid or other treatment fluid to be pumped down the tubing and out into the formation. To prevent the treatment fluid from passing through the bypass passageway the latter is isolated from the tubing.

Preferably, the formation fluid is lifted up the tubing by means of a reverse flow jet pump located within the bypass passageway. Upon ceasing the flow of power fluid to the jet pump the blocking means, which preferably is a plug, is removed in response to the application of hydraulic pressure, and the bypass is blocked, preferably by a sleeve, which also moves in response to hydraulic pressure. The period of time between halting the production of formation fluid and introducing treatment fluid can be very short, requiring as little as ten minutes or so, which allows the treatment fluid to enter the formation while the formation pressure near the wellbore is still reduced as a result of the production operation.

This not only more accurately defines the zone in which fracturing is to take place, but results in much less down time of the well since it is no longer necessary to spend time physically removing a downhole pumping mechanism prior to introducing treatment fluid or running in special hydraulic fluid application tools.

The above features of the invention, as well as other aspects and benefits, will readily be apparent from the more detailed description of the preferred embodiment of the invention which follows.

DETAILED DESCRIPTION OF THE PREFERRED EMBODIMENT

Figure 1:
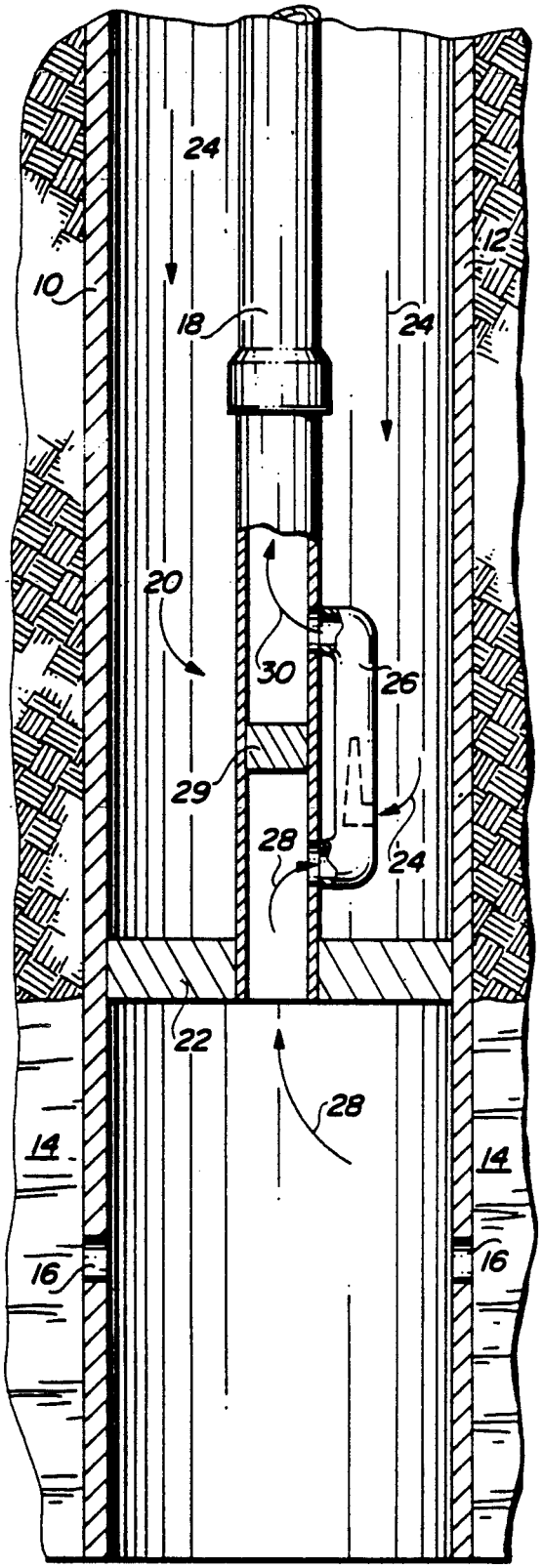
FIG. 1 is a partial schematic longitudinal sectional view of a wellbore and casing, including a tubing assembly incorporating the features of the present invention, illustrating the flow of produced fluid from the surrounding formation.

Referring to FIG. 1, a casing 10 in a wellbore 12 extends from the surface down into a formation 14 containing fluid it is desired to produce. For this purpose, the casing contains perforations 16 through which formation fluid can flow. Located within the casing 10 is a tubing string 18 the lower portion of which comprises a jet pump assembly 20. A packer 22 at the bottom of the assembly 20 seals the annulus between the tubing string and the casing to prevent formation fluid from flowing up the annulus.

During production of the formation 14 power fluid indicated by the flow arrows 24 is pumped down the annulus between the tubing string 18 and the casing 10 and is caused to enter a tubing bypass, schematically shown at 26, in which a reverse flow jet pump, shown in dotted lines, is located. The resulting upward flow of the power fluid causes upwardly flowing formation fluid, indicated by the flow arrows 28, to mix with the power fluid in the bypass. Note that the formation fluid is forced to enter the bypass due to the presence of the plug or seal 29. The mixture of the power fluid and the formation fluid then continues to flow up the tubing string, as indicated by the flow arrow 30 and as explained in more detail hereinafter.

Figure 2:
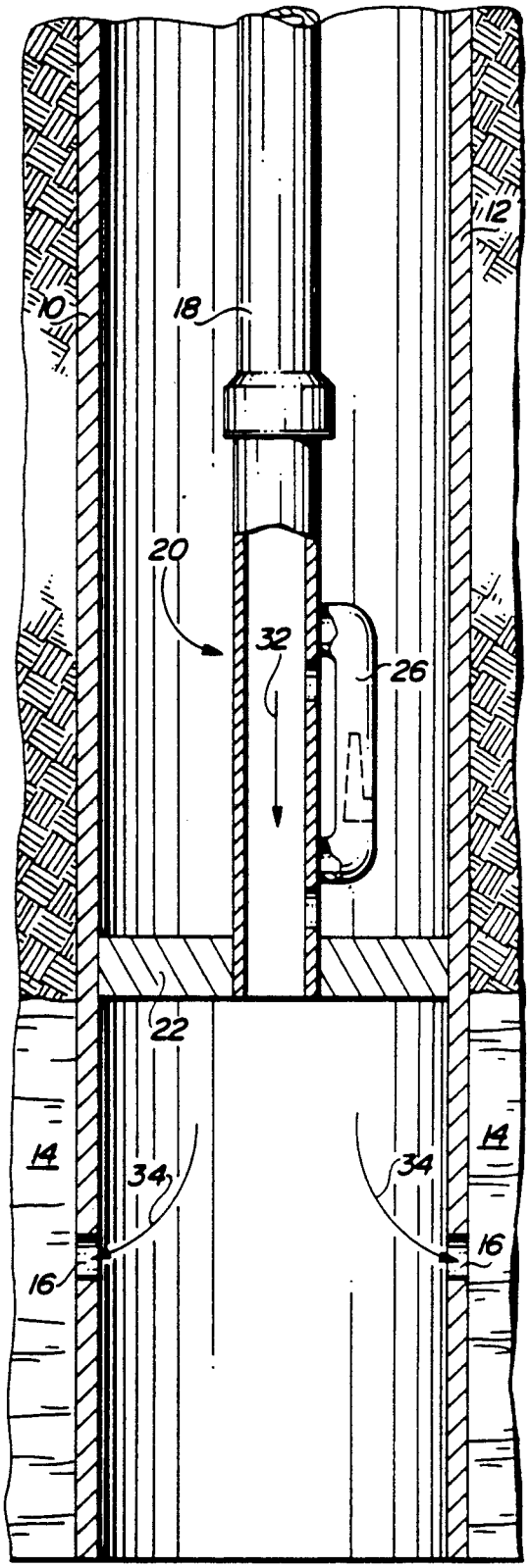
FIG. 2 is a partial schematic longitudinal sectional view of the wellbore and casing, similar to that of FIG. 1, but showing the flow of treatment fluid into the surrounding formation.

As illustrated in FIG. 2, when it is desired to introduce treatment fluid into the formation 14, the pumping of power fluid is stopped and the pumping of treatment fluid is begun. The flow of treatment fluid down through the tubing string and out the casing perforations 16, which is made possible by removing the plug 29 and blocking the inlet and outlet of the bypass 26, is indicated by the flow arrow 32. Since the introduction of treatment fluid can be commenced soon after the cessation of production of the formation fluid, the treatment fluid will preferentially flow into the formation 14, as indicated by the flow arrows 34, because the formation will still be at a lower pressure than the layers surrounding it due to the effects of the recent pumping of fluid out of the formation.

Figure 3:
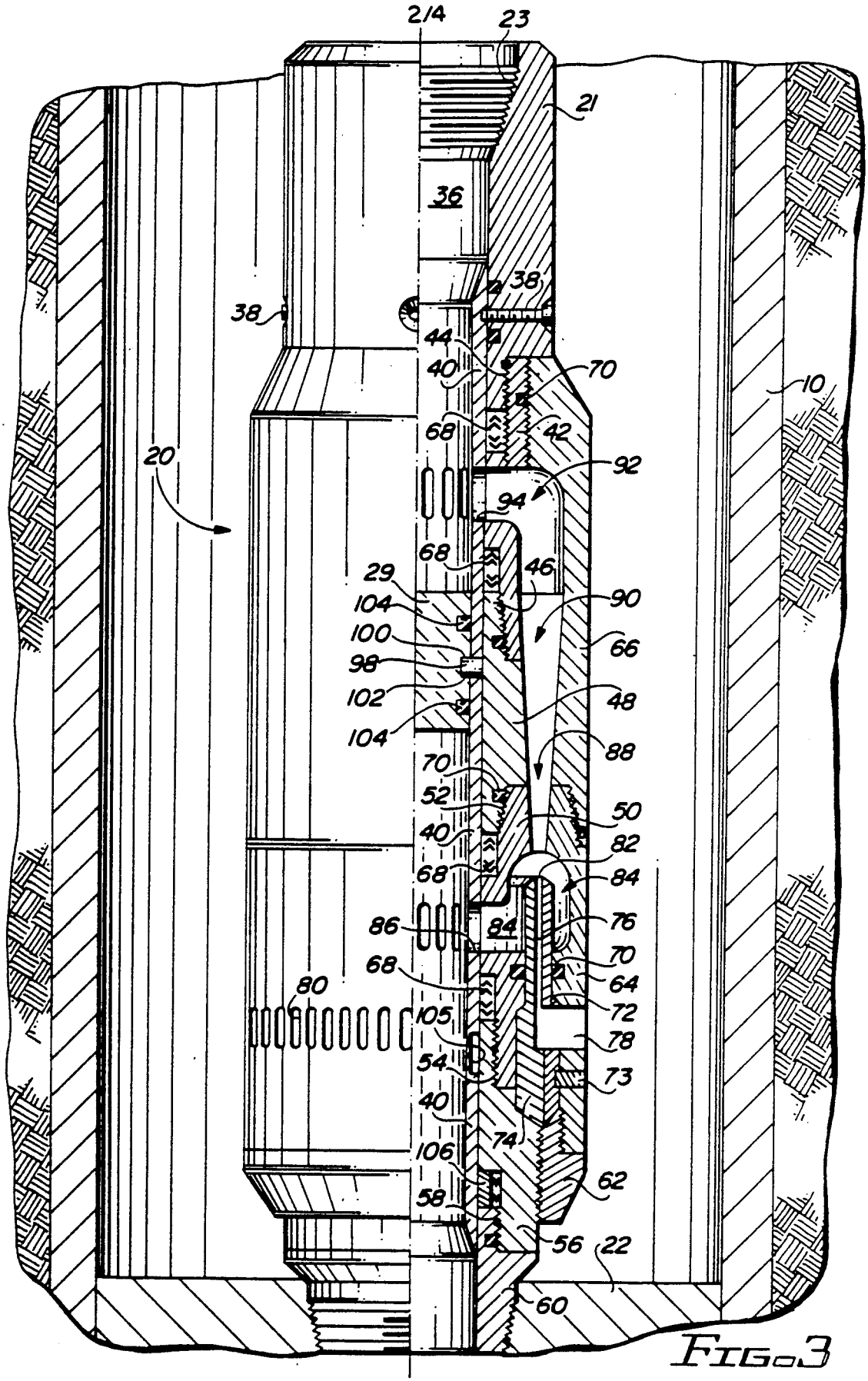
FIG. 3 is an enlarged partial longitudinal sectional view of a tubing assembly incorporating a jet pump for use in the present invention, illustrating the assembly as formation fluid is being produced.

Turning to FIG. 3, which shows the jet pump assembly in greater detail, the assembly 20 comprises a generally cylindrical upper end section 21 having a threaded socket 23 for receiving the male threaded end of the tubing string 18. The central portion of the section 21 contains a bore 36 which comprises part of the flow path through the assembly. Connected to the lower portion of the section 21 by circumferentially spaced shear pins 38 is a cylindrical liner 40 which forms the main flow path through the assembly. Extending radially outwardly from the liner 40 is the remainder of the assembly which forms the annular type of reverse flow jet pump illustrated.

A sleeve 42 is connected by screw threads 44 and 46 at its end portions to the lower threaded end of the end section 21 and to the upper threaded end of a sleeve 48. In like manner sleeve 50 is connected by screw threads 52 and 54 at its end portions to the lower threaded end of the sleeve 48 and to the upper threaded end of sleeve 56. The lower end of sleeve 56 is connected by threads 58 to lower sleeve 60, the lower portion of the inner surface of which forms a part of the flow path at the entry to the jet pump assembly. Completing the wall of the assembly is a relatively short sleeve 62 attached by threads to the sleeve 56, a sleeve 64 attached by threads to the sleeve 62, and a sleeve 66 attached by threads to the sleeve 64. The connections between the various sleeves adjacent the liner 40 are sealed by various annular chevron packing seals 68, while the connections between the various sleeves remote from the liner are sealed by various O-rings 70.

Situated within portions of sleeves 56, 62, 50 and 64 is an annular nozzle assembly comprised of annular plates 72 and 74 forming an annular space 76 therebetween. The outer plate 72, shown to be secured to the sleeve 64 by means of spaced bolts 73, is connected to short conduits 78 which communicate with the annulus between the casing 12 and the tubing string through a series of circumferentially spaced openings 80 in the sleeve 64. The plates 72 and 74 are shaped at their upper end portions so as to be very closely spaced apart, forming an annular nozzle 82. The plates 50 and 64 further contain cavities which surround the nozzle 82 and which form a flow path 84 leading from a series of circumferentially spaced openings 86 in the liner 40. The plates 50 and 64 are further spaced apart at their upper end portions to form a narrow annular tapered channel 88 which connects with a wider annular tapered channel 90 formed by the space between sleeve 66 and sleeves 48 and 42. The narrow tapered channel 88 comprises the throat portion and the wider channel 90 comprises the diffuser portion of the annular jet pump. Continuing from the channel 90 is a channel or chamber 92 formed by the spaced sleeves 66 and 42. The channel 92 communicates with the tubing string through a series of circumferentially spaced openings 94 in the liner 40.

Located within the tubular liner 40 between the openings 80 and 94 is the relatively short cylindrical plug 29. The plug 29, which preferably is metal but which may be formed of any material suited to the purpose, is keyed to the liner 40 by circumferentially spaced shear pins 98 extending into aligned openings 100 and 102 in the plug and the liner. O-ring seals 104 are provided upstream and downstream from the shear pins 98 to seal the plug against fluid flow around it. The upward flow path from the bore of the jet pump assembly through the openings 86, the throat and diffuser sections 88 and 90, the chamber 92 and the openings 94 thus constitutes a bypass passageway which causes formation fluid to bypass the plug 29. For operating reasons made clear below, the shear strength of the pins 98 holding the plug 29 in place is greater than the shear strength of the pins 38 holding the liner 40 in place.

The lower portion of the liner 40 is provided with recesses or notches 105 which are adapted to receive locking members or key elements 106 when aligned with the keys. The elements 106 may be of any suitable design capable of causing the elements to move radially inwardly into the notches 105 when they are aligned.

In operation, as illustrated in FIGS. 1 and 3, when power fluid is pumped down the annulus between the tubing string 18 and the casing 12 it enters the nozzle 82 through the openings 80. As is well known in the operation of jet pumps, the narrow nozzle opening has a venturi effect, causing rapid flow of the power fluid which mixes the formation fluid with it in the throat and diffuser sections 88 and 90. The mixed fluids flow through the chamber 92, out the openings 94, up the bore 36 of the jet pump assembly and up through the tubing string to the surface. The flow of fluid from the formation 14 over a period of time causes the pressure in the formation to be reduced. If the production operation were stopped and the normal period of time required by the use of conventional apparatus were to elapse prior to introducing hydraulic fracturing fluid into the formation, the formation pressure would have already risen to the point where the introduction of the hydraulic fluid is opposed by the formation pressure. According to the invention, however, hydraulic fracturing fluid can be injected into the formation 14 in a very short period of time, as little as ten minutes or so, by simply stopping the introduction of power fluid and introducing hydraulic fracturing fluid down through the tubing string.

Figure 4A:
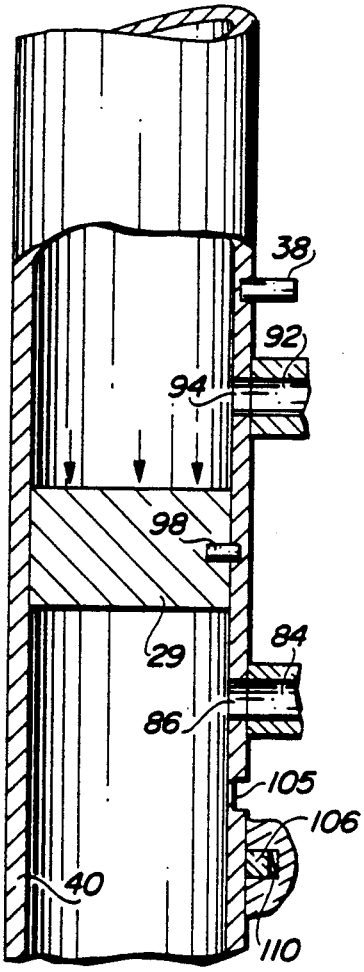
FIGS. 4A, 4B and 4C are sequential schematic views illustrating the relative positions of the main elements of the assembly during the various stages of operation.
Figure 4B:
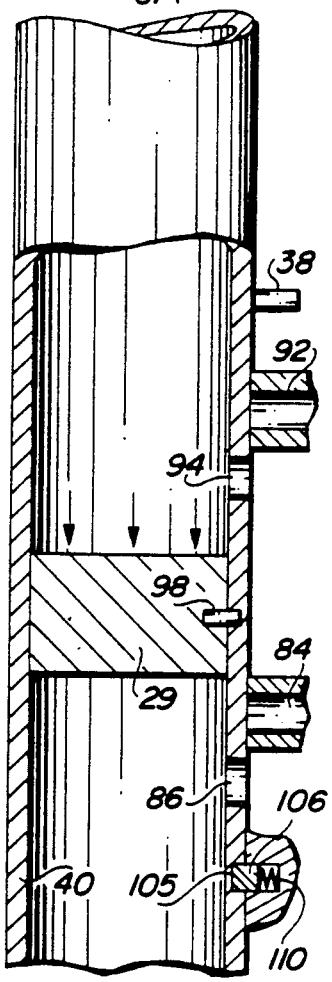
Figure 4C:
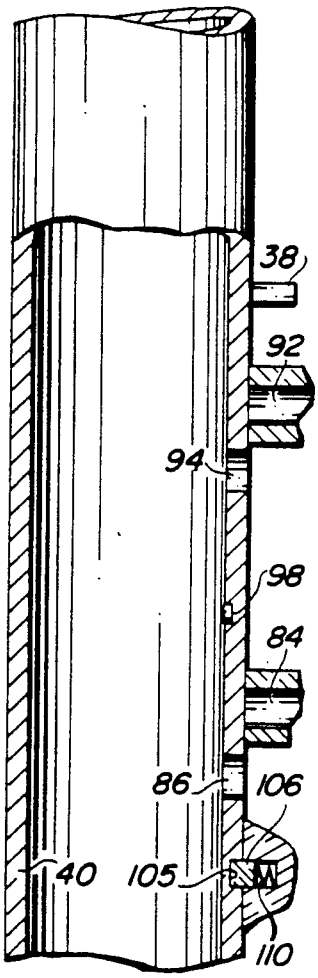

The condition of the various movable elements in the assembly 20 at the time hydraulic fluid is introduced into the bore of the assembly is illustrated schematically in FIG. 4A. At this stage the hydraulic fluid first strikes the upper surface of the plug 29, tending to move the plug and attached sleeve 40 downwardly. The pressure of this force is soon greater than the resistance of the shear pins 38 but not greater than the resistance of the plug shear pins 98, causing the pins 38 to shear off and allow the plug and liner to move down as a unit. When the notches 105 in the liner become aligned with the key elements 106 as the liner and plug assembly move downwardly, the elements are forced into the notches to halt the downward movement of the liner. This condition is illustrated in FIG. 4B. Continued application of hydraulic pressure against the plug soon produces a force which is greater than the resistance of the shear pins 98 but not greater than the resistance of the locking or key elements 106, causing the pins 98 to shear off. This results in the plug being pushed by the hydraulic fluid down through the bottom end of the jet pump assembly bore, as illustrated in FIG. 4C, and down into the wellbore. The hydraulic fluid now has a clear fluid path directly through the tubing string 18 and the liner 40 and into the formation through the perforations 16 shown in FIG. 2.

Figure 6:
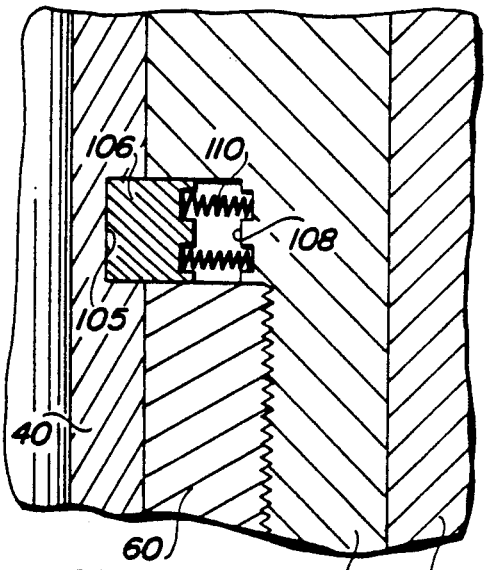
FIG. 6 is an enlarged partial sectional view of the area enclosed in the circle 6 of FIG. 5.
Figure 7:
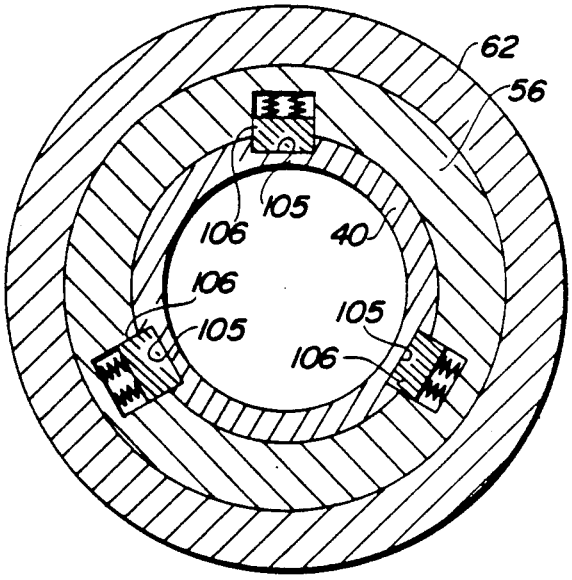
FIG. 7 is a transverse sectional view taken on line 7—7 of FIG. 5.
Figure 5:
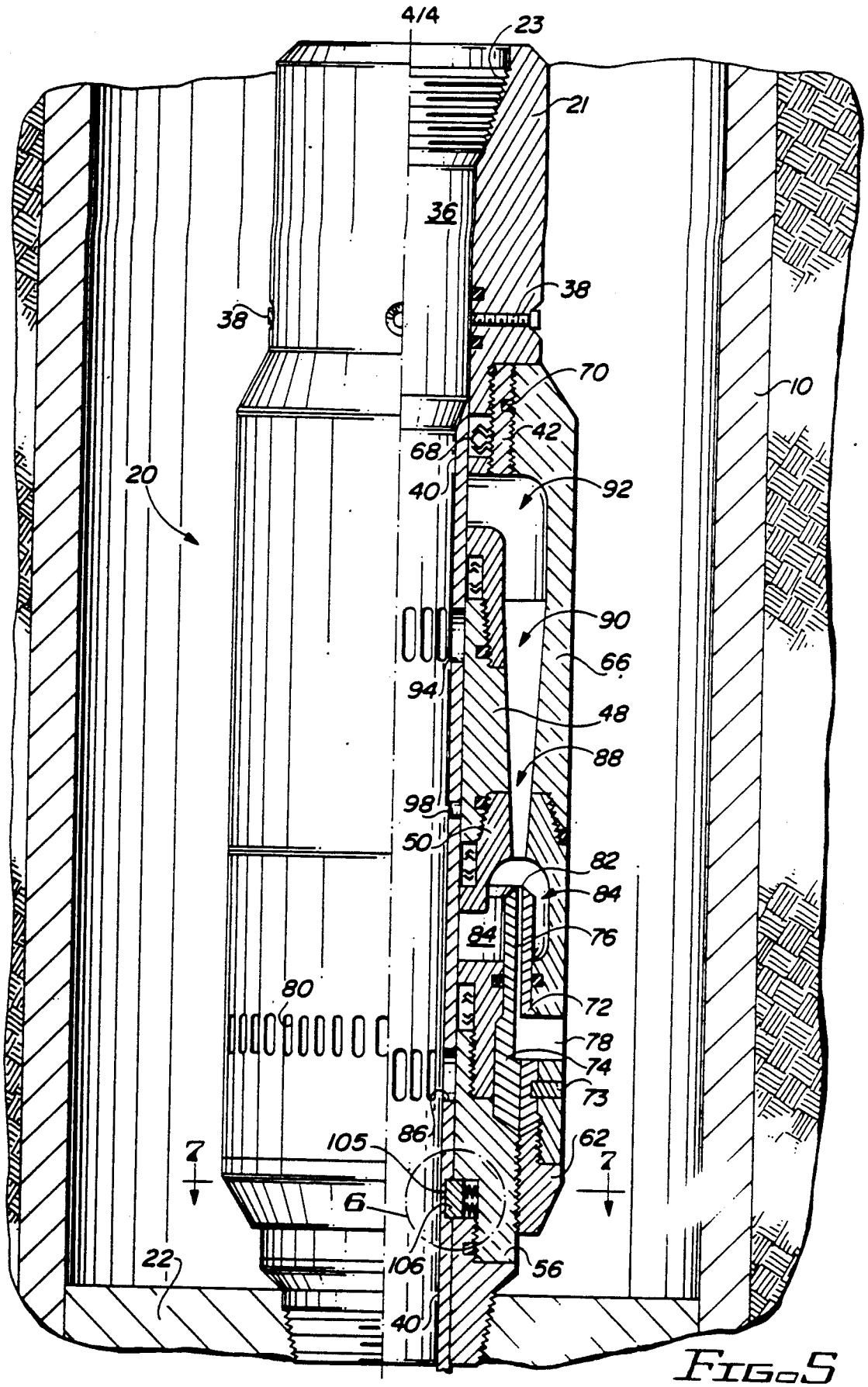
FIG. 5 is a view similar to that of FIG. 3, but showing the assembly as it would appear when treatment fluid is flowing therethrough.

The assembly at this stage is as shown in FIG. 5, wherein the liner 40 has been pushed down to a location where it blocks the inlet and outlet openings 86 and 94 leading to the jet pump nozzle. This is necessary in order to provide a clear fluid path to the perforations in the well casing. As shown in FIG. 6 the locking elements are mounted in recesses 108 in the sleeve 56 and are biased in a radially inward direction by springs 110 which not only maintain the elements in locking position but also function to rapidly move the key elements into the notches 105 in order to ensure entry of the elements into the notches. Obviously, other locking designs could be used, but it is preferred that a quick-acting biasing force be provided to move the elements radially inwardly. As shown in FIG. 7, the locking elements 106 preferably comprise spaced segments extending about the inner periphery of the sleeve 56 in vertical alignment with the notches 105.

Although the annular or concentric jet pump described is a preferred form of reverse flow jet pump for use in the present invention due to its efficiency and ability to handle large volumes of rapidly flowing fluid, it will be understood by those skilled in the art that other jet pump designs may also be used. For example, a jet pump located in a Y-type single bypass arm arrangement may be employed. This would enable the bypass design of the preferred embodiment to be used since the bypass passageway would still communicate with the tubing sleeve by means of openings in the sleeve.

The invention is not limited to the particular plug and sliding sleeve arrangement described but may utilize any suitable arrangement which enables formation fluid to be pumped up through the bypass and which can be modified in a short time to permit treatment fluid to be introduced through the tubing. The advantage of the disclosed arrangement, however, is the ability to rapidly remove the blocking and bypass functions simply by the application of hydraulic pressure, in this case by the pressure of the treatment fluid itself.

Although the invention is highly useful when used in connection with the introduction of hydraulic fracturing fluid, since the function of such fluid is enhanced by being able to introduce it while the formation of interest is at a reduced pressure, it will be understood that it may also be used to introduce other treatment fluids into a surrounding formation.

It should now be apparent that the invention is not necessarily limited to all the specific details described in connection with the preferred embodiment, but that changes to certain features of the preferred embodiment which do not alter the overall basic function and concept of the invention may be made without departing from the spirit and scope of the invention, as defined in the appended claims.

What is claimed is:

1. Apparatus for introducing treatment fluid into a subterranean formation through a perforated casing, comprising:

tubing positioned in the casing;

means located above the perforations in the casing for sealing the annulus between the tubing and the casing;

means for lifting fluid from the formation through the perforations and up through the tubing;

said lifting means including tubing bypass means located above the sealing means, the bypass means comprising a conduit connected to the tubing by an inlet and an outlet to permit lifted formation fluid to flow through the bypass, the outlet being upwardly spaced from the inlet; and means for isolating the bypass means from the tubing to permit treatment fluid to be introduced to the formation down through the tubing and out the casing perforations.

2. The apparatus of claim 1, wherein the tubing bypass means further comprises means for blocking fluid flow in the tubing between the inlet and outlet during the lifting of formation fluid.

3. The apparatus of claim 2, wherein the means for blocking fluid flow in the tubing comprises a plug located between the inlet and outlet, the plug being capable of resisting the pressure of the formation fluid during lifting thereof.

4. The apparatus of claim 3, wherein the means for isolating the bypass means comprises means for blocking the inlet and outlet.

5. The apparatus of claim 2, wherein the means for isolating the bypass means comprises a slidably mounted sleeve containing openings aligned with the inlet and outlet of the conduit during the lifting of formation fluid, and means for causing the sleeve to slide down and cover the inlet and outlet of the conduit in response to the introduction of treatment fluid into the tubing.

6. The apparatus of claim 5, wherein the means for blocking fluid flow in the tubing comprises a plug mounted in the sleeve between the inlet and outlet of the conduit and being connected to the sleeve, the means for causing the sleeve to slide down comprising relatively weak connecting means connecting the sleeve to the tubing, whereby pressure of treatment fluid on the plug which is greater than the resistance of the relatively weak connecting means will break the connecting means and push the plug and the connected sleeve down.

7. The apparatus of claim 6, including means for holding the sleeve in place while the sleeve is covering the inlet and outlet of the conduit.

8. The apparatus of claim 7, wherein the means for holding the sleeve in place comprises recess means in the sleeve and locking means engaging the recess means.

9. The apparatus of claim 7, wherein the means for holding the sleeve in place is relatively strong, whereby the pressure of treatment fluid on the plug which is greater than the resistance of the connection between the plug and the sleeve but less than the resistance of the means for holding the sleeve in place will cause the plug to be forced out of the sleeve to clear a fluid passage for the introduction of treatment fluid into the formation.

10. The apparatus of claim 1, wherein the means for lifting fluid up through the tubing string comprises a reverse flow jet pump having a nozzle located in the tubing bypass.

11. The apparatus of claim 10, wherein the reverse flow jet pump includes a power fluid inlet in communication with the annulus between the tubing and the casing.

12. The apparatus of claim 11, wherein the reverse flow jet pump comprises an annular nozzle concentric with the tubing.

13. A method for introducing treatment fluid into a subterranean formation through a perforated casing, comprising:

positioning a tubing string in the casing;

sealing the annulus between the tubing and the casing at a location above the perforations in the casing;

lifting fluid from the formation through the perforations and up through the tubing;

causing the fluid from the formation to flow through a tubing bypass located above the sealing means, the bypass being connected to the tubing by an inlet and an outlet spaced upwardly from the inlet;

ceasing the lifting of fluid from the formation;

isolating the bypass from the tubing; and introducing treatment fluid down through the tubing, out the casing perforations and into the formation.

14. The method of claim 13, including the step of blocking fluid flow in the tubing between the inlet and outlet during the lifting of formation fluid.

15. The method of claim 14, including the step of ceasing to block the fluid flow in the tubing between the inlet and outlet while blocking the inlet and outlet to allow treatment fluid to flow through the tubing and out the casing perforations.

16. The method of claim 15, wherein formation fluid is caused to flow through the bypass by means of a reverse flow jet pump located in the bypass.

17. The method of claim 13, wherein the treatment fluid is hydraulic fracturing fluid, the lifting of formation fluid being carried out for a sufficiently long period of time to lower the pressure in the subterranean formation and the hydraulic fracturing fluid being introduced into the formation while the pressure in the formation is still in a reduced state.

18. A reverse flow jet pump for lifting fluid from a subterranean formation and permitting the introduction of treatment fluid into the formation after ceasing to produce fluid from the formation, comprising:

a tubing section adapted to be aligned with a tubing string in a wellbore;

a tubing bypass connected to the tubing section by an inlet and an outlet, the outlet being upwardly spaced from the inlet;

a nozzle in the bypass for producing upward flow through the bypass;

a power fluid inlet connected to the nozzle for permitting the delivery of power fluid thereto; and means for isolating the bypass from the tubing section to permit treatment fluid to be introduced into the formation through the tubing section and out the casing perforations.

19. The reverse flow jet pump of claim 18, wherein the tubing section bypass comprises means in the tubing section between the inlet and outlet of the conduit for blocking the flow of fluid through the tubing section between the inlet and the outlet.

20. The reverse flow jet pump of claim 19, wherein the means for isolating the bypass comprises means for blocking the inlet and outlet of the conduit.

21. The reverse flow jet pump of claim 20, wherein the means for blocking the inlet and outlet of the conduit comprises a movably mounted sleeve containing openings aligned with the inlet and outlet of the conduit during operation of the jet pump, and means for causing the sleeve to move over the inlet and outlet of the conduit in response to the introduction of treatment fluid into the tubing section.

22. The reverse jet flow pump of claim 21, wherein the means for blocking fluid flow in the tubing section comprises a plug mounted in the sleeve between the inlet and outlet of the conduit and being connected to the sleeve, the means for causing the sleeve to move comprising relatively weak connecting means connecting the sleeve to the tubing section, whereby pressure of treatment fluid on the plug which is greater than the resistance of the relatively weak connecting means will break the connecting means and move the plug and the connected sleeve.

23. The reverse jet pump of claim 22, including means for holding the sleeve in place while the sleeve is covering the inlet and outlet of the conduit.

24. The reverse jet pump of claim 23, wherein the means for holding the sleeve in place comprises recess means in the sleeve and locking means biased toward and engaging the recess means.

25. The reverse jet pump of claim 23, wherein the means for holding the sleeve in place is relatively strong, whereby the pressure of treatment fluid on the plug which is greater than the resistance of the connection between the plug and the sleeve but less than the resistance of the means for holding the sleeve in place will cause the plug to be forced out of the sleeve to clear a fluid passage for the introduction of treatment fluid into the formation.

* * * * *